United States Patent [19]

Keith et al.

[11] Patent Number: 5,060,545

[45] Date of Patent: Oct. 29, 1991

[54] METHOD AND APPARATUS FOR CUTTING TOW INTO STAPLE

[75] Inventors: Charles A. Keith, Blountsville; Barbara J. Dietz; Jose F. Flores, both of Kingsport; Thomas G. Greenwood, Knoxville, all of Tenn.

[73] Assignee: Mini Fibers, Inc., Johnson City, Tenn.

[21] Appl. No.: 397,536

[22] Filed: Aug. 23, 1989

[51] Int. Cl.[5] ..... D01G 1/04

[52] U.S. Cl. ..... 83/15; 83/37; 83/170; 83/403; 83/913

[58] Field of Search ..... 83/346, 913, 37, 169, 83/403, 15, 170

[56] References Cited

U.S. PATENT DOCUMENTS

| | | | |
|---|---|---|---|
| 2,607,418 | 8/1952 | Hebeler | 83/913 X |
| 3,768,355 | 10/1973 | Farmer et al. | 83/913 X |
| 3,948,127 | 4/1976 | Vehling et al. | 83/913 X |
| 3,978,751 | 9/1976 | Farmer et al. | 83/403 |
| 4,120,222 | 10/1978 | Potter | 83/169 X |
| 4,300,422 | 11/1981 | Potter | 83/913 X |

*Primary Examiner*—Frank T. Yost
*Assistant Examiner*—Eugenia A. Jones
*Attorney, Agent, or Firm*—Burns, Doane, Swecker & Mathis

[57] ABSTRACT

An apparatus for cutting tow into staple including a shaft having a tow passageway for guiding tow into a cutting mechanism as well as fluid inlet and fluid outlet passageways for providing a cooling media to a whorl assembly; a whorl assembly attached to the shaft and having a tow outlet in communicaiton with the tow passageway and cooling fluid chambers in communication with the fluid inlet and outlets; a rotor assembly mounted around the shaft and the whorl assembly that has a plurality of cutting blades for cutting the tow that is progressing through the shaft and whorl a ssembly into staple having uniform lengths.

21 Claims, 6 Drawing Sheets

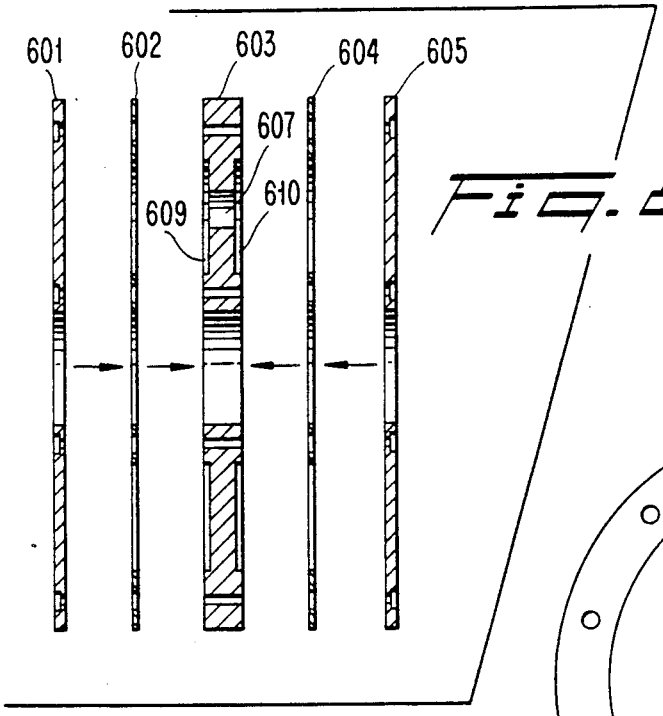
Fig. 8
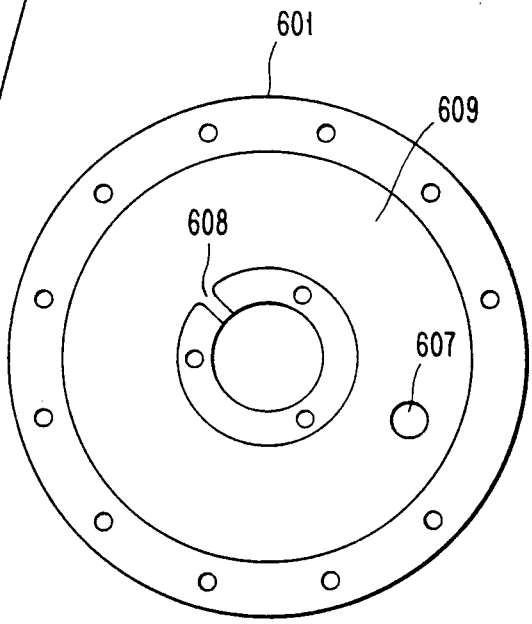
Fig. 9
Fig. 10
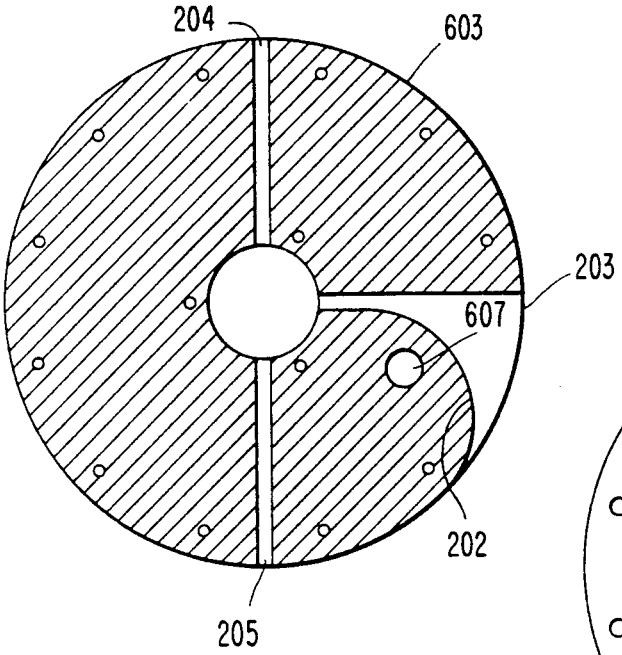
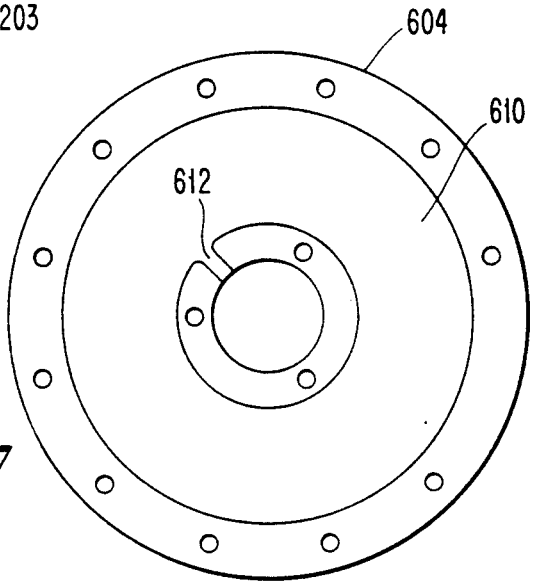
Fig. 11

METHOD AND APPARATUS FOR CUTTING TOW INTO STAPLE

FIELD OF THIS INVENTION

This invention relates to producing staple, and more particularly to methods and apparatus for cutting fibers from tow.

BACKGROUND OF THE INVENTION

The problems encountered in cutting fibers of tow or rope-like feed into staple are well-known in the textile industry. Obtaining staple having a consistent length within a desired tolerance is particularly difficult to achieve. Furthermore, when staple having a greater than desired length is produced, extreme difficulty is encountered by the subsequent processing machinery.

Fusing of the ends of the staple is an additional problem with current cutters since, oftentimes, the cutting force exerted on the tow produces localized heat which may be sufficient to melt the material being processed. Such fusion is especially a problem in the case of tow made of synthetic materials. The heat generated during the cutting of the tow also can cause the production of staple of uneven lengths since the excess heat may cause an undesirable expansion or contraction of the tow during the critical cutting operation. Yet still further, the unwanted heat oftentimes restricts the size and quantity of tow that may be processed by a certain machine.

In certain systems, wetting of the tow or rope is employed to dissipate the undesired heat. This alternative, however, is often unsatisfactory since the required subsequent drying of the tow or rope requires expensive equipment that adds costs to the product. Yet further, the wetting of the tow or rope results in increased handling, packaging and transportation costs.

A number of tow cutters have been proposed for overcoming the above-mentioned difficulties. For example, U.S. Pat. No. 3,768,355 issued to Farmer et al, sets forth an apparatus having a power operated rotatable hollow shaft that has an inlet and an outlet passage for tow or rope. As the tow or rope moves through the passageway, the front end of the tow or rope is forced to impinge against the sharp edges of radially positioned knives to cut the tow or rope into staple of substantially uniform length.

Further, U.S. Pat. No. 3,978,751, which is also issued to Farmer et al., proposes a tow cutting device having a plurality of cam surfaces to accommodate a plurality of tows to enable simultaneous cutting by a single knife assembly. An endless belt is provided between the cam surfaces and the tow, to reduce the frictional engagement between the cam surfaces and the tow thus reducing the heat generating friction to that which would occur between the endless belt and the cam surfaces. Farmer et al. proposes to reduce the heat generated between the belt and the cam surfaces as well by suggesting the use of one of three embodiments. The first embodiment uses an air, gas or liquid bearing medium between the cam surface and the belt; the second embodiment uses a rotating circular cam surface; the third embodiment suggests using both an air, gas or liquid bearing medium and a rotating circular cam surface.

The proposed tow cutting devices, however, do not completely meet the demands of the industry since such machines are oftentimes unduly complicated and expensive. Furthermore, the generation of excessive heat continues to be a problem which both restricts the full capability and reduces the potential efficiency of any particular machine. In particular, the present machines remain unable to produce staple of a desired length within certain low tolerances. The present machines are also restricted to processing tows having a certain range of diameter and quantity.

OBJECTS AND SUMMARY OF THE INVENTION

An object of the present invention is to provide an apparatus for cutting fibrous tow into staple that addresses the above-mentioned problems.

Another object of the present invention is to remove and/or reduce the frictional heat generated by the tow and the cutting mechanism.

It is a further object of the present invention to provide a tow cutting device that will provide staple with a uniform length within certain tolerances.

It is still a further object of the present invention to provide a tow cutting apparatus capable of processing tow or rope of differing diameters and quantity.

An additional object is to provide a tow cutting device which is relatively inexpensive to produce and operate and which is relatively maintenance free and which provides consistent, uniform results.

The above-identified objects, as well as other objectives not specifically set forth, are accomplished by providing an apparatus for cutting staple fibers comprising:

a shaft having a tow passageway, a fluid inlet passageway and a fluid outlet passageway;

a whorl assembly fixedly attached to the shaft and having a tow outlet in communication with the tow passageway, a whorl inlet in communication with the fluid inlet passageway and a whorl outlet in communication with the fluid outlet passageway; and a rotor assembly rotatably mounted around the shaft and having a plurality of cutting knives disposed substantially circumferentially around the whorl assembly for cutting a tow into staple fibers.

BRIEF DESCRIPTION OF THE DRAWINGS

These objects are accomplished in accordance with a preferred embodiment of which is illustrated in the accompanying drawings wherein like numbers refer to like items, and in which;

FIG. 8 is a cross-sectional view of the whorl assembly of FIG. 6 showing the components separated to show the relative arrangement;

FIG. 9 is a plan view of a gasket of the whorl assembly of FIG. 6;

FIG. 10 is a plan view of the center plate of the whorl assembly of FIG. 6; and FIG. 11 is a plan view of a gasket of the whorl assembly of FIG. 6.

DETAILED DESCRIPTION

Figure 1:
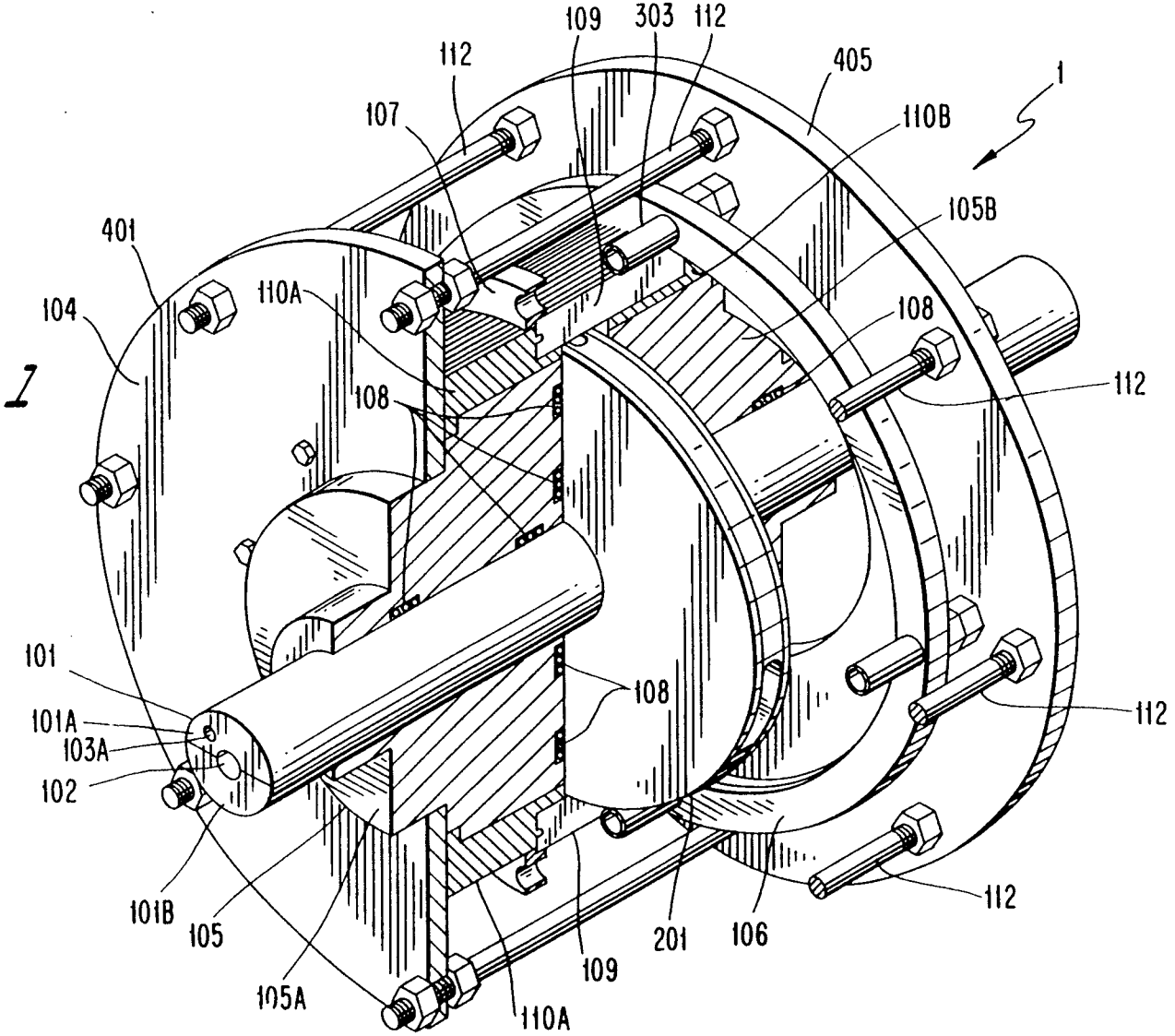
FIG. 1 is a partially in cross-sectional perspective view of the apparatus of the present invention.

FIG. 1 shows an apparatus for cutting tow into staple 1 according to a preferred embodiment of the present invention having a stationary shaft 101, a whorl assembly 201 and a rotor assembly 401. The whorl assembly 201 is fixed to the shaft 101 and the rotor assembly 401 is rotatably disposed on both the shaft 101 and the whorl assembly 201. As the rotor assembly 401 is caused to rotate around the whorl assembly 201 and shaft 101, tow is cut to produce staple having a length within certain low tolerances.

Figure 2:
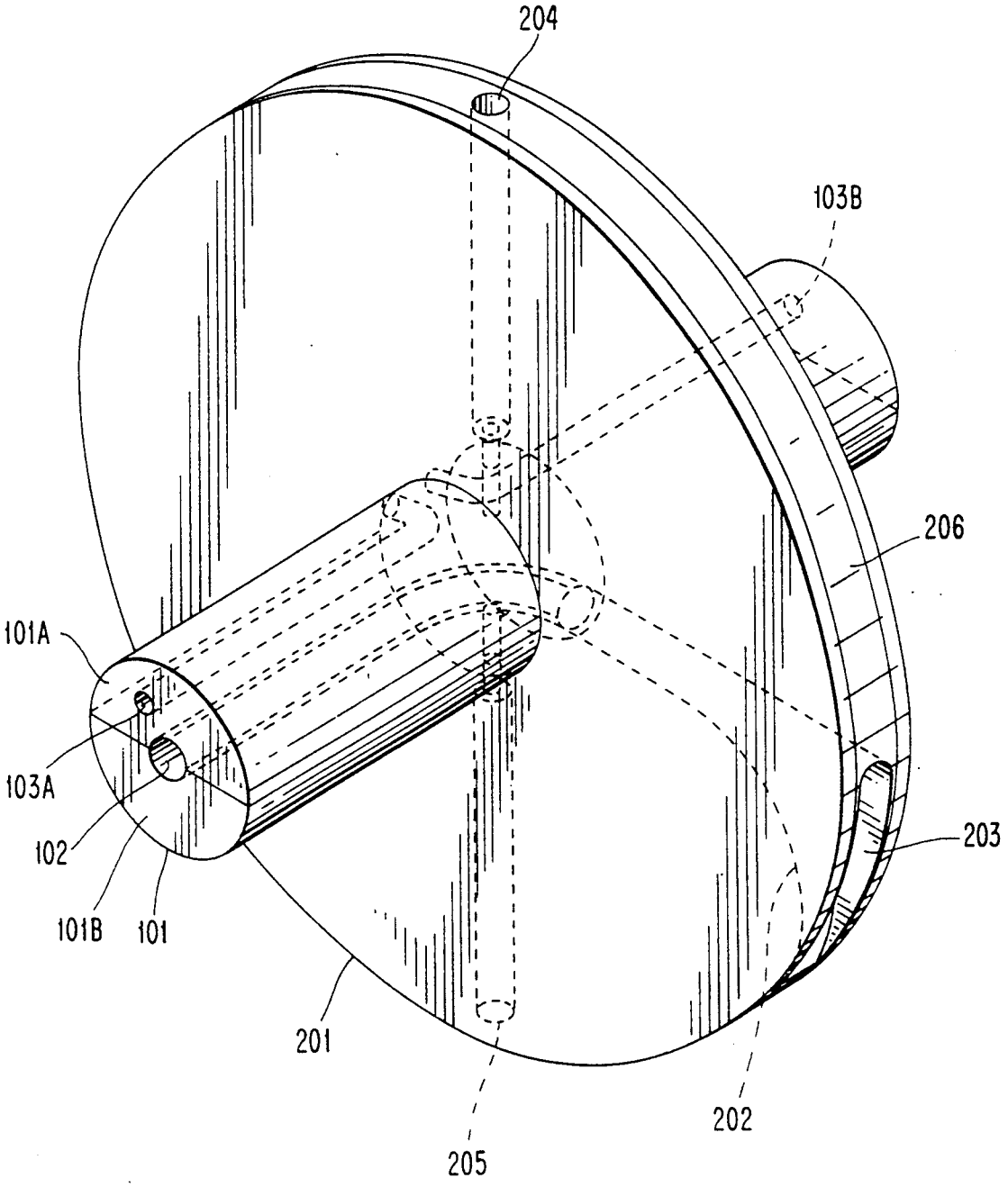
FIG. 2 is a perspective view of the shaft and whorl assembly of the device of FIG. 1.

The shaft 101 is comprised of a first piece 101A and a second piece 101B. The two pieces 101A and 101B are symmetrical halves such that when the two pieces 101A and 101B are joined to form the shaft 101, the resulting split line extends through a center axis of the resulting circular shaft. Each of the pieces 101A and 101B include grooves that serve to form a tow passageway 102 when the two pieces are joined to form shaft 101. In addition to having a groove that serves to form tow passageway 102, the first piece 101A also has a fluid inlet passageway 103A. FIG. 2 shows that the first piece 101A also includes a fluid outlet passageway 103B. The shaft 101 could, in the alternative, be made in one piece.

Attached to the shaft 101 via conventional fasteners (not shown), is the whorl assembly 201 as shown in FIG. 2. The conventional fasteners (not shown) are inserted at two locations 204, 205 to threadably engage the shaft 101. The conventional fasteners (not shown) orient the whorl assembly 201 such that a tow path opening 203 of the whorl assembly 201 is in alignment with the tow passageway 102 of the shaft 101. Consequently, tow that is inserted into the passageway 102 of the shaft 101 is guided through the shaft 101 and out of the whorl assembly 201 through the tow path opening 203.

The tow path opening 203 extends over an arcuate segment of the circumference of whorl assembly 201 and has a curved surface 202 upon which the tow will travel as it proceeds through opening 203. The remainder of the circumference of the whorl assembly 201 includes a groove 206 for guiding the tow as it is being cut within the apparatus 1.

Figure 3:
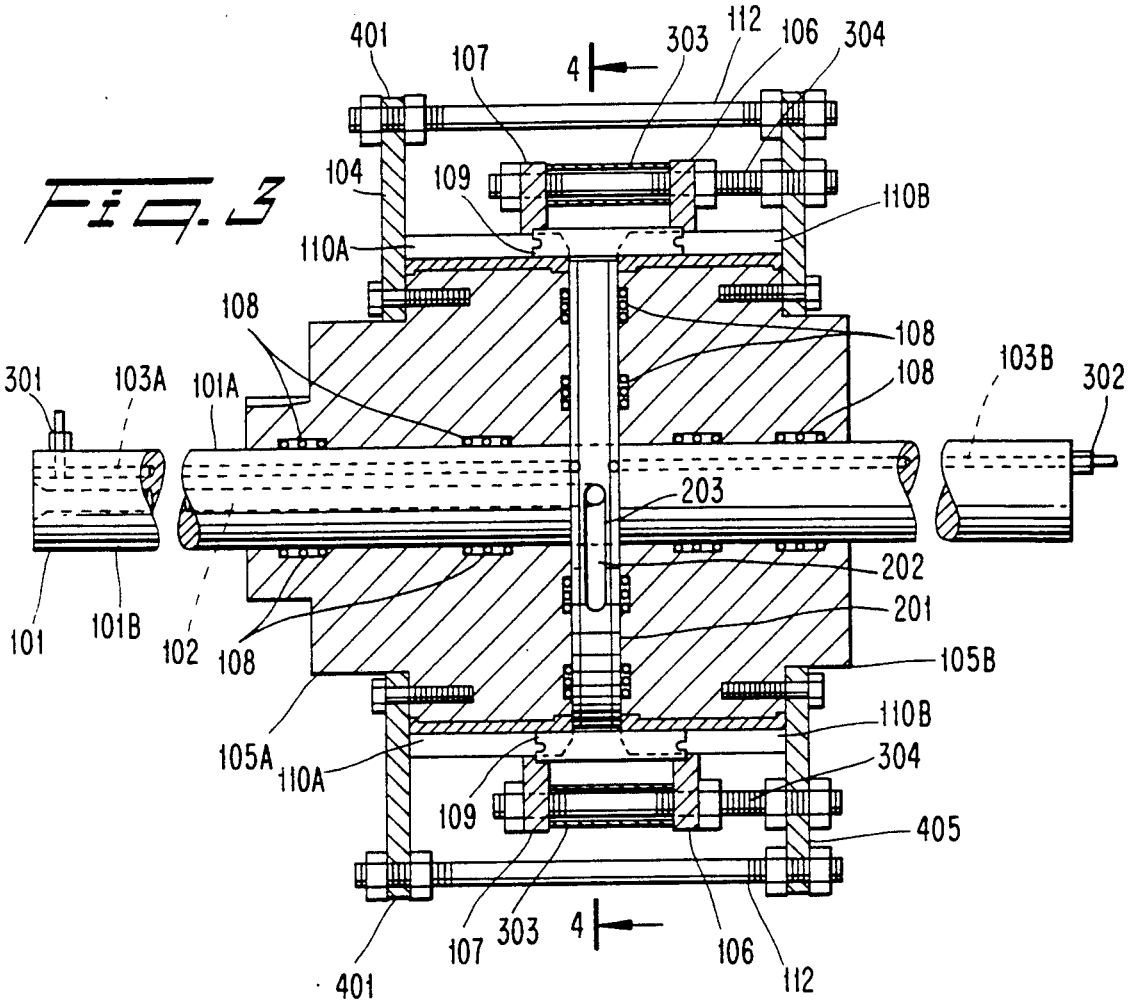
FIG. 3 is a cross-sectional view of the assembly along the line 3—3 in FIG. 4.

Referring now to FIGS. 1 and 3, the rotor assembly 401 is rotatably mounted both on the shaft 101 and the whorl assembly 201 according to a plurality of bearings 108. The rotor assembly 401 includes a two piece hub 105 wherein a first hub portion 105A is located on a first side of the whorl assembly 201 and a second hub portion 105B is arranged on a second side of the whorl assembly 201. Attached by conventional means to the first hub portion 105A is a first side plate 104. Similarly, attached to the second hub portion 105B, is a second side plate 405. The first and second side plates 104, 405 are connected to each other by a plurality of fasteners 112 that are distributed at equally spaced intervals around the outer edge of each of the plates. In this manner, the first and second side plates 104, 405 along with the first and second hub portions 105A, 105B form the skeletal structure of the rotor assembly 401.

Fixedly mounted in a circumferential manner around each of the hub portions 105A, 105B are first and second cutter supports 110A, 110B, respectively. Arranged at equally spaced intervals around the circumference of each of the cutter supports 110A, 110B are grooves (not shown), each one of which is adapted to slidably support a cutter 109. The grooves are arranged to extend in a manner parallel with the axis of the rotor assembly 401.

Each of the grooves (not shown) in the first cutter support 110A has a corresponding groove (not shown) in the second cutter support 110B such that when a cutter is placed within the corresponding groove of each support, the cutting edge of the cutter 109 extends in a manner parallel with the axis of the rotor assembly 401. A cutter so placed bridges the space between the two supports 110A, 110B so that the exposed cutting portion is positioned in close proximity to the circumference of the whorl assembly 201.

Corresponding to the first and second cutter supports 110A, 110B are first and second ring knife holders 107, 106, respectively. The first and second ring knife holders 107, 106 are annular in geometry, and include on an inner circumference grooves for fixedly retaining each of the cutters 109 that are supported by the grooves of the cutter supports 110A, 110B. At a predetermined length which is dictated by spacer 303, the first ring knife holder 107 is separated from the first ring knife holder 106. An adjustable fastener 304 secures the first ring knife holder 107 to the second ring knife holder 106 and, in turn, secures both holders to the second plate 405. According to rotation of the adjustable fastener 304, the first and second ring knife holders 107, 106 may be translated in a direction parallel with the axis of the rotor assembly 401 within the space between the first and second plates 104, 405. Such translation causes corresponding movement of each of the cutters 109 so that the exposed cutting portion of each of the cutters 109 may always be a sharp portion of the cutter 109.

Figure 4:
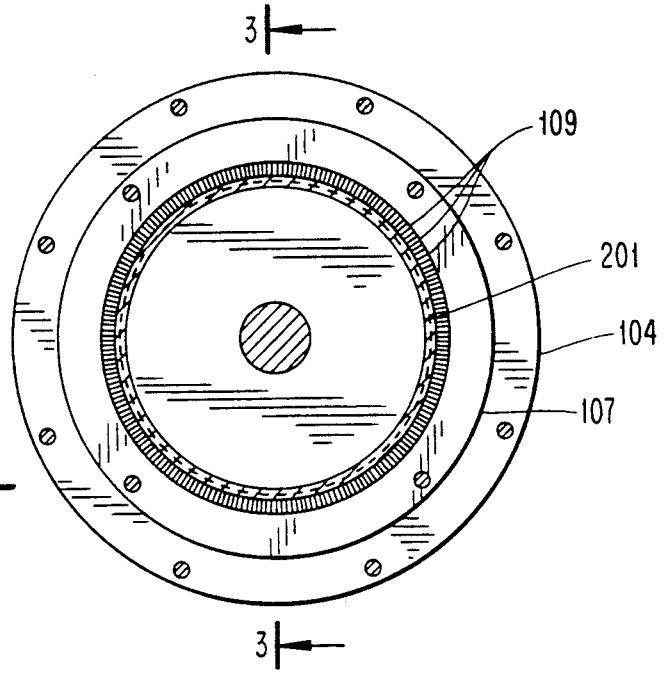
FIG. 4 is an cross-sectional view of the assembly along the line 4—4 in FIG. 3.

The circumferential arrangement of the cutters 109 within the inner circumference of the first ring knife holder 107 is more clearly shown in FIG. 4. The number and spacing of cutters can be varied according to the desired length of staple and the type of tow being processed.

Figure 5:
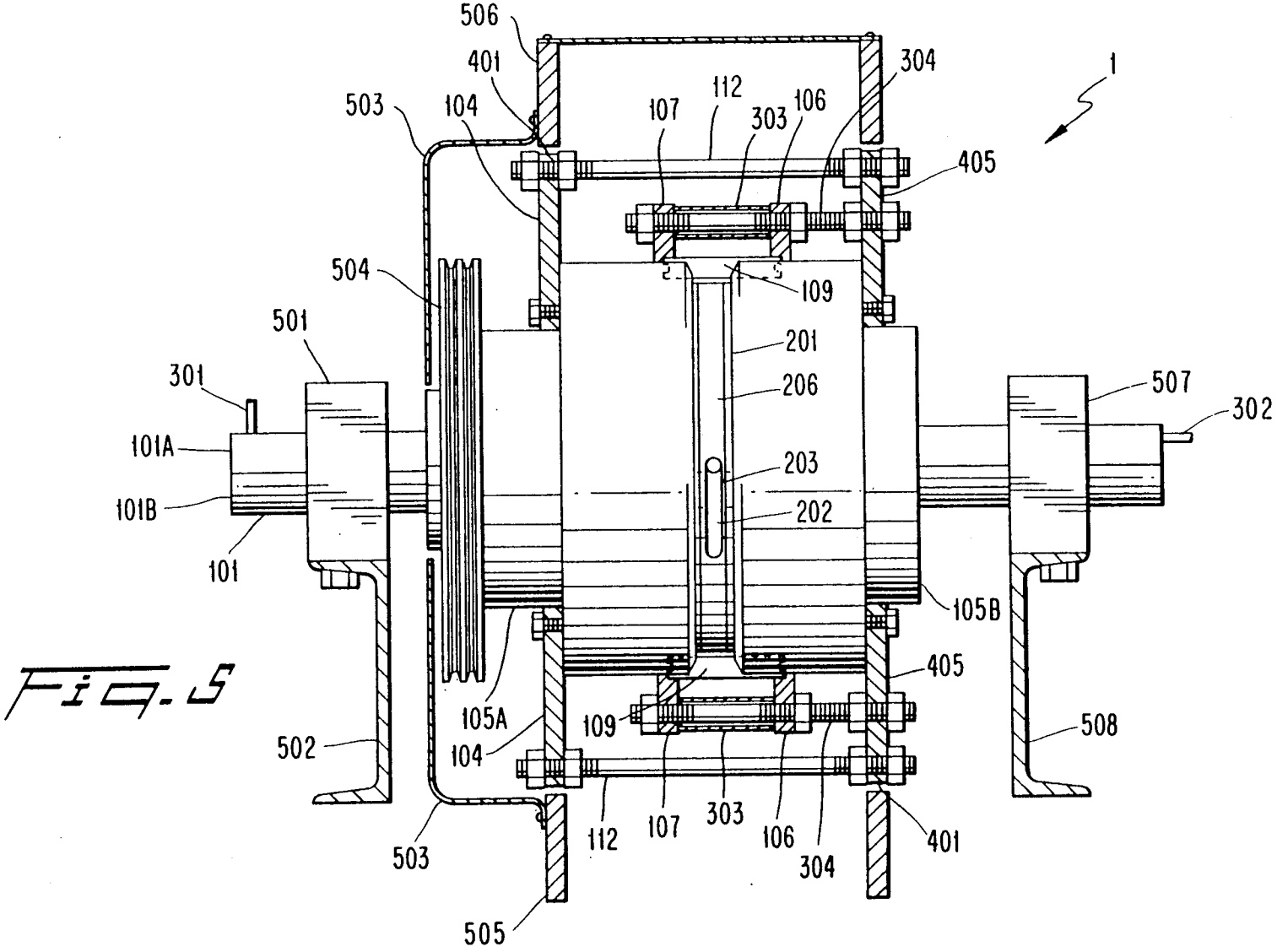
FIG. 5 is an elevational view of an installation for operating of the present invention.

Referring to FIG. 5, a system for operating the apparatus for cutting staple fibers 1 is shown having first and second fixed shaft clamps 501, 507 that are situated on corresponding first and second supports 502, 508, respectively. The first fixed shaft clamp 501 is shown to fixedly support a first end of the shaft 101 and the second fixed shaft clamp 507 is shown to fixedly support a right end of shaft 101. Attached on a circumference of the first hub portion 105A is a driven sprocket 504 which is linked to a motor drive (not shown) by a belt (not shown). Surrounding the rotor assembly 401 is stationary shielding that includes a covered hood 506, a belt guard 503 and a chute 505. The shield is primarily protective in nature yet it also provides a passageway through the chute 505 for delivering staple to a subsequent destination.

When the motor (not shown) is energized, the driven sprocket 504 is urged to rotate through the belt (not shown). Since the driven sprocket 504 is fixedly disposed on the first hub portion 105A, the entire rotor assembly 401 is thus caused to rotate. After the rotor assembly 401 reaches an appropriate speed, tow is inserted into the tow passageway 102 of the shaft 101 by an air jet, vacuum or other means known within the art. The tow is advanced through the shaft 101 via tow passageway 102 and into the tow path opening 203 of the whorl assembly 201. As the tow advances out of the tow path opening 203, the tow will encounter the exposed portion of each of the cutters 109 that will be rotating with the rotor assembly. The exposed portions of the cutters 109 will initially urge the tow against the curved portion 202 of the opening 203. As the tow is yet further urged out of the tow path opening 203, however, the rotating cutters 109 will urge the tow into the groove 206 of the whorl assembly 201 and begin exerting a cutting force thereon. As the cutters continue to rotate around the whorl assembly 201, the tow will be cut into staple of substantially uniform length wherein the staple will circumferentially exit the rotor assembly 401 through the spaces separating each of the cutters 109. The staples exiting from the rotor assembly 401 will then be deposited into the chute 505 to a desired destination.

To facilitate the production of staple having a length within certain low tolerances as well as to enable the apparatus to process tow of varying diameters and quantity, a preferred embodiment of the present invention further includes a whorl assembly 201 adapted for cooling the tow and the apparatus, as shown in FIGS. 6–11. In particular, the whorl assembly 201 is adapted to receive and remove a cooling media such as water from shaft 101.

Figure 6:
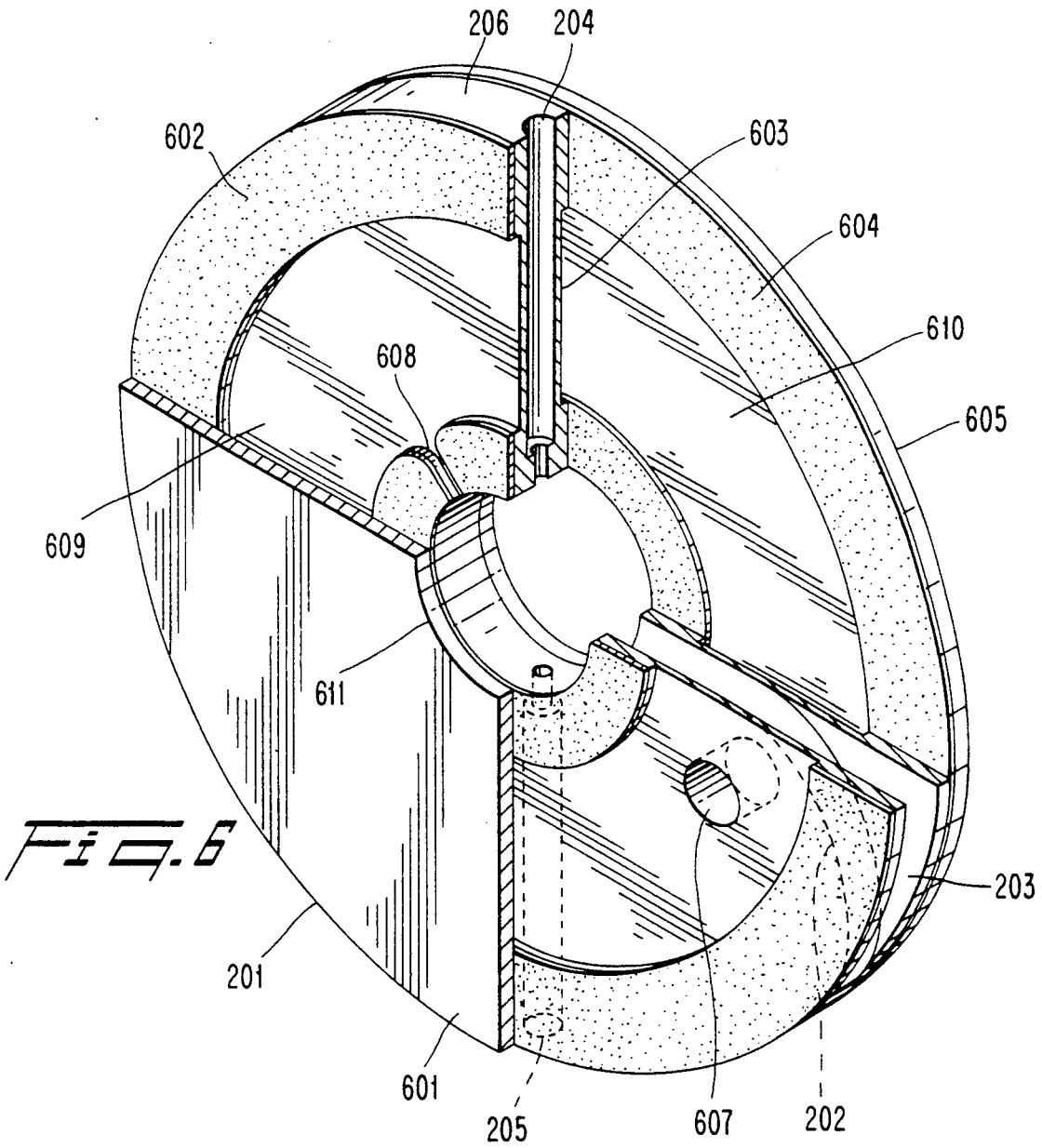
FIG. 6 is a perspective view of a whorl assembly.
Figure 7:
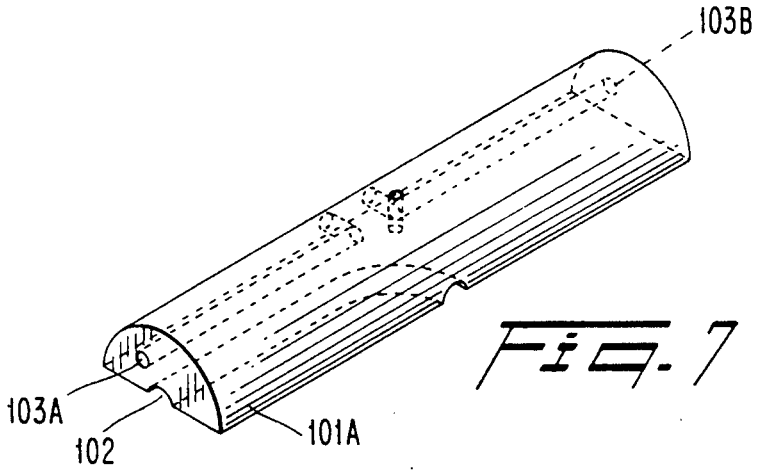
FIG. 7 is a perspective view of a portion of the shaft of the apparatus.

As shown in FIG. 6, the whorl assembly 201 includes a whorl inlet 608 that is adapted for fluid communication with the fluid inlet passageway 103A of the shaft 101. The whorl inlet 608 communicates the cooling fluid from the shaft 101 with a first chamber 609 located on a first side of the whorl assembly 201. The first chamber 609 is in fluid communication with a second chamber 610 located on a second side of a whorl assembly 201 via a communicating port 607. Finally, the second chamber 610 is in fluid communication with the fluid outlet passageway 103B of shaft 101 through a whorl outlet 612 (see FIG. 11). According to the fluid connections herein described, cooling fluid is able to enter a first side of the whorl assembly 201, flow to a second side of a whorl assembly 201 and exit into the outlet passageway 103 of the stationary shaft 101.

In order to provide a whorl assembly having the passageways above described, the whorl assembly 201 incorporates a number of components including first and second outer plates 601, 605, first and second gaskets 602, 604 and a center plate 603 as shown in FIGS. 6 and 8–11. On each of the sides of the center plate 603 are annular depressions which serve to form one wall of the first and second chambers 609, 610, respectively. The center plate 603 also includes the connecting port 607 for providing fluid communication between the two chambers 609 and 610. The first and second gaskets 602, 604 each include an annulus that corresponds with the annular depression formed on each of the sides of the center plate 603. When the whorl assembly 201 is assembled, the first and second gaskets 602, 604 are compressed by the first and second outer plates 601, 605, respectively, to the respective sides of the center plate 603 to provide a fluid seal for each of the chambers 609, 610, respectively, in a conventional manner. The first and second outer plates 601, 605 provide walls opposite the annular depressions of the center plate 603 to complete the formation of the chambers 609, 610, respectively.

As the apparatus for cutting staple fibers 1 is operated as previously described, cooling fluid, such as water, is provided to the fluid inlet passageway 103A of shaft 101. The fluid flows through the inlet passageway 103A, through the whorl inlet 608 and into the first cooling chamber 609 of the whorl assembly 201. Through communicating port 607, the cooling fluid then flows to the second chamber 610 of the whorl assembly. From the second chamber 610, the fluid thus exits the second chamber 610 through the whorl outlet 612. From the whorl outlet 612, the fluid then exits shaft 101 through the fluid outlet passageway 103B.

As the fluid passes through the whorl assembly, the heat generated from friction between the tow and the whorl assembly surfaces is substantially absorbed and removed. Consequently, the expansion and/or contraction of the tow that might otherwise occur is avoided and the machine can more consistantly provide a staple having a length within low tolerances. In addition, the machine will be able to process a wider range of tow diameters and quantities. Yet still further, the removal of the heat will allow the apparatus to operate more efficiently.

The form of the invention shown and described in this disclosure represents a preferred embodiment. It is understood that various additional changes and variations are possible without departing from the spirit of the invention as defined in the claimed subject matter which follows.

What is claimed is:

1. An apparatus for cutting staple fibers, comprising:

a shaft having a tow passageway;

a fluid inlet passageway and a fluid outlet passageway disposed in said shaft, said tow passageway and said fluid inlet passageway being substantially parallel to each other and extending from one end of said shaft to a whorl assembly support region on said shaft a whorl assembly fixedly attached to said shaft at said whorl assembly support region, said whorl assembly having a tow outlet in communication with said tow passageway, said whorl assembly including a cooling enclosure having a whorl inlet in communication with said fluid inlet passageway and a whorl outlet in communication with said fluid outlet passageway, and a rotor assembly rotatably mounted around said shaft and having a plurality of cutting knives disposed substantially circumferentially around said whorl assembly for cutting a tow into staple fibers.

2. An apparatus for cutting staple fibers according to claim 1, wherein said cooling enclosure of said whorl assembly includes a first fluid chamber disposed on a first side of said whorl assembly and a second fluid chamber disposed on a second side of said whorl assembly, said first chamber being in fluid communication with said whorl inlet and said second fluid chamber being in fluid communication with said whorl outlet, said first and second chambers being in fluid communication with each other by a communicating port.

3. An apparatus for cutting staple fibers according to claim 1, wherein said rotor assembly includes first and second ring cutter holders for retaining said plurality of cutting knives and wherein said first and second ring cutter holders are axially movable within said rotor assembly so as to selectively adjust an exposed cutting edge of each of said plurality of cutting knives.

4. An apparatus for cutting staple fibers according to claim 1, wherein said rotor assembly includes a first cutter support mounted on a rotatable first hub portion and a second cutter support mounted on a rotatable second hub portion, said first and second hub portions being disposed on a first and second side of said whorl assembly, respectively.

5. An apparatus for cutting staple fibers according to claim 4, wherein said first and second cutter supports include means for supporting said plurality of cutting knives such that an exposed cutting surface of said knives is located in close proximity to an outer circumference of said whorl assembly.

6. An apparatus for cutting staple fibers according to claim 5, wherein said exposed cutting surfaces extend in a manner parallel with an axis of said rotor assembly.

7. An apparatus for cutting staple fibers according to claim 1, wherein said shaft is comprised of a first piece and a second piece, said fluid inlet passageway and said fluid outlet passageway being disposed within said first piece.

8. An apparatus for cutting staple fibers according to claim 1, wherein said shaft is non-rotatable.

9. An apparatus for cutting staple fibers, comprising:

a shaft having a tow passageway, a fluid inlet passageway and a fluid outlet passageway, a whorl assembly fixedly attached to said shaft having a tow outlet in communication with said tow passageway, a whorl inlet in communication with said fluid inlet passageway and a whorl outlet in communication with said fluid outlet passageway, said whorl assembly including a first fluid chamber disposed on a first side of said whorl assembly and a second fluid chamber disposed on a second side of said whorl assembly, said first chamber being in fluid communication with said whorl inlet and said second fluid chamber being in fluid communication with said whorl outlet, said first and second chambers being in fluid communication with each other by a communicating port, said whorl assembly also including a center plate having a first annular depression on a first side of said center plate to form a first wall of said first fluid chamber and a second annular depression on a second side of said center plate to form a first wall of said second fluid chamber, and a rotor assembly rotatably mounted around said shaft and having a plurality of cutting knives disposed substantially circumferentially around said whorl assembly for cutting a tow into staple fibers.

10. An apparatus for cutting staple fibers according to claim 9, wherein said whorl assembly includes a first outer plate disposed on said first side of said center plate that provides a second wall for said first fluid chamber and a second outer plate disposed on a second side of said center plate that provides a second wall for said second fluid chamber.

11. An apparatus for cutting staple fibers according to claim 10, wherein said first side of said center plate and said first outer plate are separated by a first fluid sealing gasket and said second side of said center plate and said second outer plate are separated by a second fluid sealing gasket.

12. An apparatus for cutting staple fibers, comprising:

a shaft having a tow passageway;

a fluid inlet passageway and a fluid outlet passageway disposed in said shaft, said tow passageway and said fluid inlet passageway being substantially parallel to each other and extending from one end of said shaft to a whorl assembly support region on said shaft, a whorl assembly fixedly attached to said shaft at said whorl assembly support region, said whorl assembly having a tow outlet in communication with said tow passageway, said whorl assembly including a cooling enclosure having a whorl inlet in communication with said communication with said fluid outlet passageway, fluid inlet passageway and a whorl outlet in a rotor assembly rotatably mounted around said shaft and having a plurality of cutting knives disposed substantially circumferentially around said whorl assembly for cutting a tow into staple fibers, first and second fixed shaft clamps for holding said shaft stationary, a driven sprocket fixedly disposed on said rotor assembly for rotating said rotor assembly around said shaft and said whorl assembly.

13. An apparatus for cutting staple fibers according to claim 12, wherein said driven sprocket is caused to rotate by a motor.

14. An apparatus for cutting staple fibers according to claim 12, further comprising means for urging a tow through said tow passageway.

15. A method of cutting staple fibers comprising the steps of:

providing a substantially continuous supple of tow to a whorl assembly of a tow cutting apparatus through a tow passageway of a shaft, said whorl assembly being supported by said shaft;

providing a cooling fluid along a fluid inlet passageway disposed within said shaft to a cooling enclosure of said whorl assembly to absorb and remove heat generated within said cutting apparatus, said fluid inlet passageway being disposed substantially parallel to said tow passageway; and cutting said tow into staple of substantially uniform length as said tow exits said whorl assembly.

16. A method of cutting staple fibers according to claim 15, wherein said tow exits said whorl assembly through a tow path opening and is then positioned in a cutting region of said cutting apparatus.

17. A method of cutting staple fibers according to claim 16, wherein said cooling fluid is provided to at least one of a plurality of cooling chambers of said cooling enclosure within said whorl assembly.

18. A method of cutting staple fibers according to claim 17, wherein said whorl assembly is maintained stationary during cutting of said tow into staple.

19. A method of cutting staple fibers according to claim 17, wherein said cooling fluid is provided to a first chamber of said whorl assembly and then to a second chamber of said whorl assembly before exiting said cutting apparatus.

20. A method of cutting staple fibers according to claim 15, wherein said tow is cut into staple by cutters carried on a rotating rotor assembly.

21. A method of cutting staple fibers according to claim 20, wherein said rotor assembly rotates around a stationary whorl assembly.

* * * * *